US006121592A

United States Patent [19]

Fishman et al.

[11] Patent Number: 6,121,592

[45] Date of Patent: Sep. 19, 2000

[54] INDUCTION HEATING DEVICE AND PROCESS FOR THE CONTROLLED HEATING OF A NON-ELECTRICALLY CONDUCTIVE MATERIAL

[75] Inventors: Oleg S. Fishman, Maple Glen, Pa.; Rudolph K. Lampi, Tabernacle, N.J.; John H. Mortimer, Medford, N.J.; Vitaly A. Peysakhovich, Moorestown, N.J.

[73] Assignee: Inductotherm Corp., Rancocas, N.J.

[21] Appl. No.: 09/187,562

[22] Filed: Nov. 5, 1998

[51] Int. Cl.[7] ..... H05B 6/04

[52] U.S. Cl. ..... 219/661; 219/656; 219/667

[58] Field of Search ..... 219/661, 662, 219/633, 663, 665, 666, 667; 307/31, 32, 33

[56] References Cited

U.S. PATENT DOCUMENTS

| | | | |
|---|---|---|---|
| 4,241,250 | 12/1980 | Steigerwald | 219/620 |
| 4,506,131 | 3/1985 | Boehm et al. | 219/662 |
| 4,600,823 | 7/1986 | Hiejima | 219/663 |
| 4,755,648 | 7/1988 | Sawa | 219/661 |
| 5,079,399 | 1/1992 | Itoh et al. | 219/662 |
| 5,165,049 | 11/1992 | Rotman | 323/212 |
| 5,349,167 | 9/1994 | Simcock | 219/662 |
| 5,508,497 | 4/1996 | Fabianowski et al. | 219/663 |
| 5,523,631 | 6/1996 | Fishman et al. | 307/38 |
| 5,908,575 | 6/1999 | Smith et al. | 219/633 |
| 5,990,465 | 11/1999 | Nakaoka et al. | 219/629 |

*Primary Examiner*—Teresa Walberg
*Assistant Examiner*—Jeffrey Pwu
*Attorney, Agent, or Firm*—Seidel, Gonda, Lavorgna & Monaco, PC

[57] ABSTRACT

An induction heating device for controlling the temperature distribution in an electrically conductive material, or susceptor, when heated by induced eddy currents in the material. A non-electrically conductive material can be heated in a controlled manner by placing the material near to the susceptor. Variable power is applied to multiple induction coil sections wound around the length of the susceptor from a power source by one or more switching circuits. The coil sections can be overlapped or counter-wound between adjacent coil sections, or provided power in a cascaded manner, to achieve desired temperature distributions in the susceptor. A control circuit is used to control the power applied to each coil section and the output of the power source. By placing a non-electrically conductive material near to the susceptor the material can be heated in a controlled manner.

10 Claims, 5 Drawing Sheets

10
111
120
60
36a
36
112
121
113
36b
114
122
115
37a
37
116
123
117
37b
118
124
119
38a
38
120
125
121
38b
122
126
CONTROL CIRCUIT
50
POWER SOURCE
20

INDUCTION HEATING DEVICE AND PROCESS FOR THE CONTROLLED HEATING OF A NON-ELECTRICALLY CONDUCTIVE MATERIAL

FIELD OF THE INVENTION

The present invention relates to induction heating, and in particular to an induction heating device and process for controlling the temperature distribution in an electrically conductive material during heating. A non-electrically conductive material can be heated with a controlled temperature distribution by placing it in the vicinity of the electrically conductive material.

BACKGROUND OF THE INVENTION

Induction heating occurs in electrically conducting material when such material is placed in a time-varying magnetic field generated by an alternating current (ac) flowing in an induction heating coil. Eddy currents induced in the material create a source of heat in the material itself.

Induction heating can also be used to heat or melt non-electrically conducting materials, such as silicon-based, non-electrically conductive fibers. Since significant eddy currents cannot be induced in non-electrically conductive materials, they cannot be heated or melted directly by induction. However, the non-electrically conductive material can be placed within an electrically conductive enclosure defined as a susceptor. One type of susceptor is a cylinder through which the non-electrically conductive material can be passed. In a manner similar to an induction coil disposed around the refractory crucible of an induction furnace, an induction coil can be placed around a susceptor so that the electromagnetic field generated by the coil will pass through the susceptor. Unlike a refractory crucible, the susceptor is electrically conductive. A typical material for a susceptor is graphite, which is both electrically conductive and able to withstand very high temperatures. Since the susceptor is electrically conductive, an induction coil can induce significant eddy currents in the susceptor. The eddy currents will heat the susceptor and, by thermal conduction or radiation, the susceptor can be used to heat an electrically non-conductive workpiece placed within or near it.

In many industrial applications of induction heating of non-electrically conductive materials such as artificial materials and silicon, it is often desired to provide a predetermined and controlled temperature distribution along the length of the susceptor to control the heat transfer to the electrically non-conductive workpiece place within it. This can be accomplished by the delivery of different densities of induction power to multiple sections of the susceptor along its length.

The susceptor can be surrounded with multiple induction coils along its length. Each coil, surrounding a longitudinal segment of the susceptor, could be connected to a separate high frequency ac power source set to a predetermined output level. The susceptor would be heated by induction to a longitudinal temperature distribution determined by the amount of current supplied by each power source to each coil. A disadvantage of this approach is that segments of the susceptor located between adjacent coils can overheat due to the additive induction heating effect of the two adjacent coils. Consequently, the ability to control the temperature distribution through these segments of the susceptor is limited.

Alternatively, the multiple coils could be connected to a single high frequency ac power source for different time intervals via a controlled switching system. Since high electrical potentials can exist between the ends of two adjacent coils when using a single power supply, it may not be possible to locate the ends of the coils sufficiently close to each other to avoid insufficient heating in the segment of the susceptor between the ends of the coil without the increased risk of arcing between adjacent coil ends. Consequently, this approach also limits the ability to control the temperature distribution through these segments of the susceptor.

There is a need for a heating device having an induction coil in which the turns of adjacent coil sections allow induction power to be delivered in a controlled manner to preselected sections along the length of the susceptor and, consequently, to a workpiece placed within or near the susceptor, including segments between coil sections, thus eliminating cold or hot spots and permitting a desired preselected temperature distribution along the length of the susceptor. This will permit a non-electrically conductive workpiece placed within the susceptor to be heated at the preselected temperature distribution by thermal conduction and radiation.

The present invention fills that need.

SUMMARY OF THE INVENTION

In its broad aspects, the present invention is an induction heating device for producing a controlled temperature distribution in an electrically conductive material or susceptor. The device includes a power source (typically comprising a rectifier and inverter), an induction coil that has multiple coil sections disposed around the length of the susceptor, a switching circuit for switching power from the power source between the multiple coil sections, and a control circuit for controlling the power duration from the power source to each of the coil sections. The coil sections may be of varying length and have a variable number of turns per unit length. The switching circuit can include SCRs connected between the power source and each termination of a coil section. Application of varying power to each coil section induces varying levels of eddy currents in the susceptor, which causes sections of the susceptor surrounded by different coil sections to be heated to different temperatures as determined by the control circuit. Consequently, a controlled temperature distribution is achieved along the length of the susceptor. The control circuit can also adjust the output of the power source to maintain a constant output when the switching circuit is switched between the coil sections. The control circuit can include sensing of a predetermined power set point for each coil section to preset average power to be supplied to each coil section. The control circuit can also include sensing of the temperature of the susceptor along its longitudinal points to adjust the power output to all coil sections in order to achieve the desired temperature distribution in the susceptor. A non-electrically conductive material can be heated by thermal conduction and radiation in a controlled manner by placing it close to the susceptor.

In another aspect of the invention, the induction heating device includes a power source, an induction coil that has one or more overlapped multiple coil sections disposed around the length of the susceptor, a switching circuit for switching power from the power source between the overlapped multiple coil sections, and a control circuit for controlling the power duration from the power source to each of the coil sections. The coil sections may be of varying length and have a variable number of turns per unit length. The switching circuit can include pairs of anti-parallel SCRs connected between the power source and each termination of a coil section. Application of varying power to each coil section induces varying levels of eddy currents in the susceptor, which causes sections of the susceptor surrounded by different coil sections to be heated to different temperatures as determined by the control circuit. Consequently, a controlled temperature distribution is achieved along the length of the susceptor. A non-electrically conductive material placed close to the susceptor will be heated by thermal conduction and radiation in a controlled fashion. The control circuit can also adjust the output of the power source to maintain a constant output when the switching circuit is switched between the coil sections. The control circuit can include sensing of a predetermined power set point for each coil section to preset average power to be supplied to each coil section. The control circuit can also include sensing of the temperature of the susceptor along its longitudinal points to adjust the power output to all coil sections in order to achieve the desired temperature distribution in the susceptor.

In still another aspect of the invention, the induction heating device includes a power source, an induction coil that has multiple coil sections disposed around the length of the susceptor, with the multiple coil sections connected to a power source by switching circuits that can apply varying power to selected multiple coil sections at the same time in a cascaded manner, and a control circuit for controlling the duration from the power source to each of the multiple coil sections. The coil sections may be of varying length and have a variable number of turns per unit length. The switching circuits can include pairs of anti-parallel SCRs connected between the power source and each termination of a coil section, except for one coil termination, which is connected to the power source. Application of varying power to the selected multiple coil sections induces varying levels of eddy currents in the susceptor, which cause sections of the susceptor surrounded by the selected multiple coil sections to be heated to different temperatures as determined by the control circuit. Consequently, a controlled temperature distribution is achieved along the length of the susceptor. A non-electrically conductive material placed close to the susceptor will be heated by thermal conduction and radiation in a controlled fashion. The control circuit can also adjust the output of the power source to maintain a constant output when the switching circuit is switched between the coil sections. The control circuit can include sensing of a predetermined power set point for each coil section to preset average power to be supplied to each coil section. The control circuit can also include sensing of the temperature of the susceptor along its longitudinal points to adjust the power output to all coil sections in order to achieve the desired temperature distribution in the susceptor.

In another aspect of the invention, the induction heating device includes a power source and an induction coil disposed around the length of the susceptor with multiple coil sections. Adjacent multiple coil sections are counter-wound to each other and connected to form a coil pair. The device further includes a switching circuit for switching power from the power source between the coil pairs. A control circuit controls the power duration from the power source to each of the coil pairs. The coil sections may be of varying length and have a variable number of turns per unit length. The switching circuit can include pairs of anti-parallel SCRs connected between the power source and the end terminations of each coil pair. Application of varying power to each coil pair induces varying levels of eddy currents in the susceptor, which causes sections of the susceptor surrounded by different coil pairs to be heated to different temperatures as determined by the control circuit. Consequently, a controlled temperature distribution is achieved along the length of the susceptor. A non-electrically conductive material placed close to the susceptor will be heated by thermal conduction and radiation in a controlled fashion. The control circuit can also adjust the output of the power source to maintain a constant output when the switching circuit is switched between the coil sections. The control circuit can include sensing of a predetermined power set point for each coil section to preset average power to be supplied to each coil section. The control circuit can also include sensing of the temperature of the susceptor along its longitudinal points to adjust the power output to all coil sections in order to achieve the desired temperature distribution in the susceptor.

These and other aspects of the invention will be apparent from the following description and the appended claims.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 1:
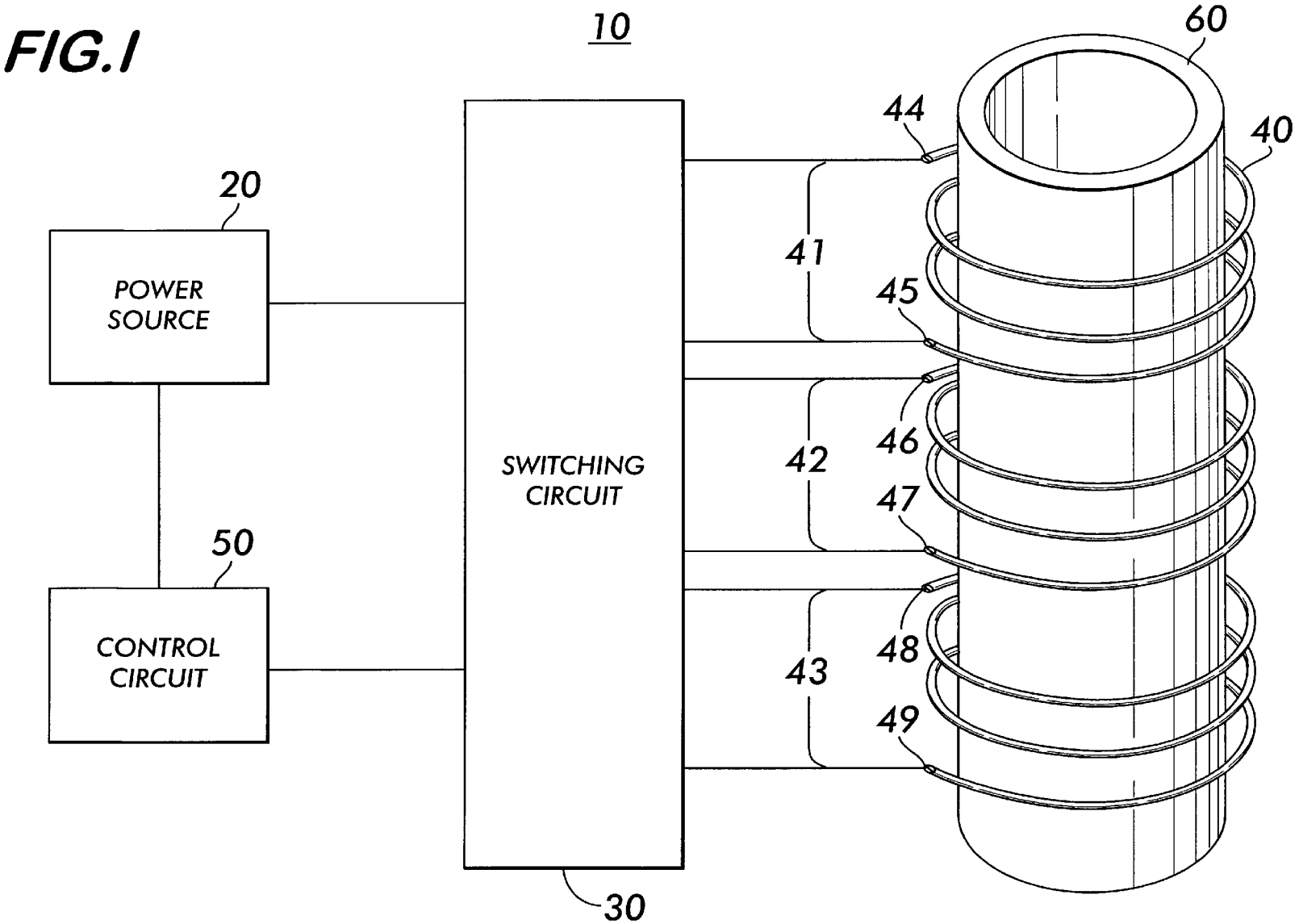
FIG. 1 is a diagram showing a power source, switching circuit, control circuit, and a multi-section induction coil of an induction heating device for controlling temperature distribution in an electrically conductive material.
Figure 5:
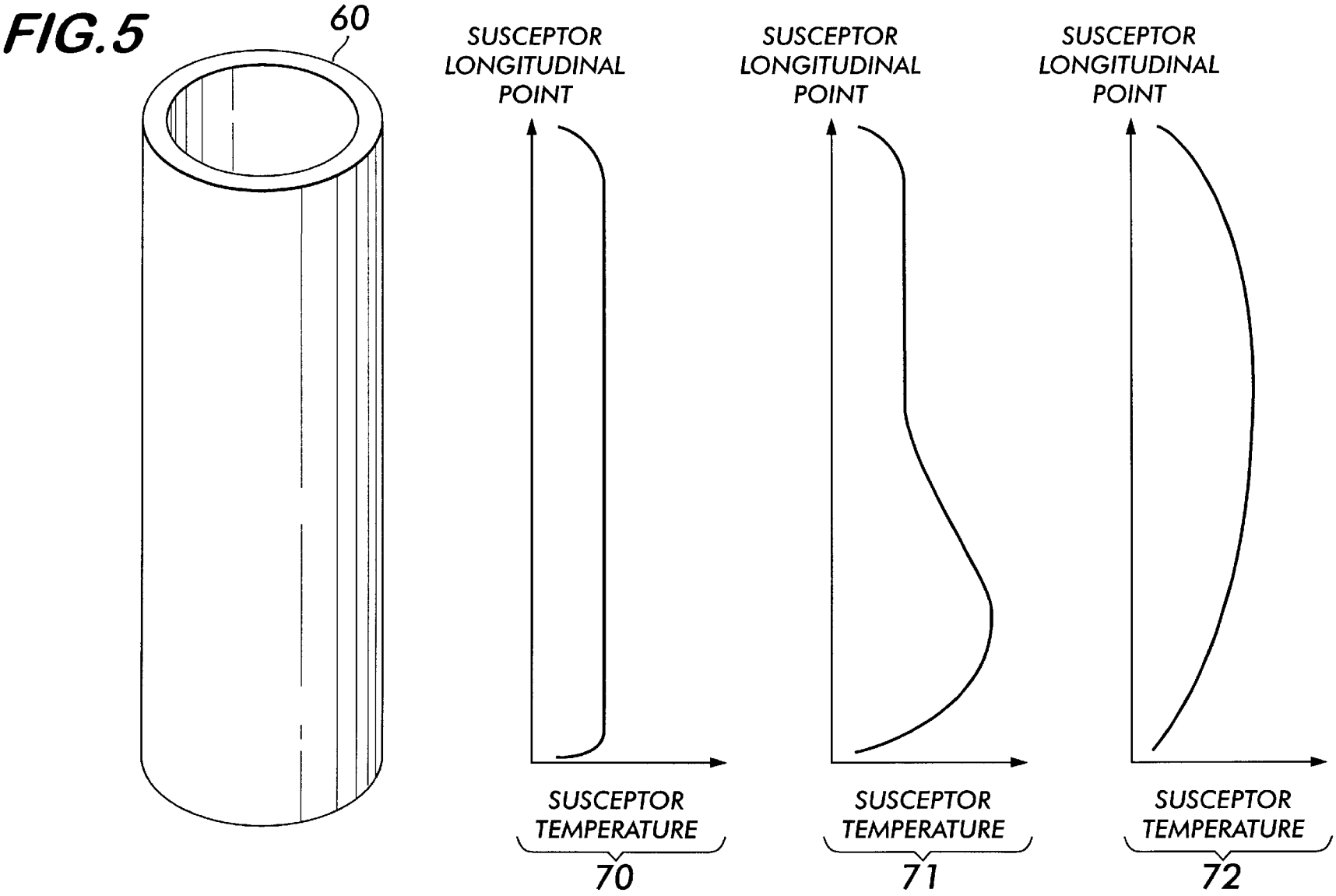
FIG. 5 is an illustration of typical controlled temperature distributions achieved in an electrically conductive material using the present invention.

Referring now to the drawings, wherein like numerals indicate like elements, there is shown in FIG. 1 a diagram for an induction heating device 10 for producing a controlled temperature distribution in an electrically conductive material or susceptor 60. The induction heating device 10 includes a power source 20 which is connected to a multi-section induction coil 40 via a switching circuit 30. Multi-section induction coil 40 is segmented into coil sections 41, 42 and 43 which extend along the length of the susceptor 60. Each coil section extends between two terminations. Terminations for the coil sections are: 44 and 45 for coil section 41; 46 and 47 for coil section 42; and 48 and 49 for coil section 43. Although three or six coil sections are shown in the disclosed embodiments of the invention for purposes of illustration, any number of coil sections can be used without departing from the scope of the invention. The coil sections in all embodiments of the invention may be of different lengths, and each coil section may have a variable number of turns per unit length to achieve a particular temperature distribution in the susceptor 60. The selection of coil length, number of turns per unit length, and other features of the coil sections are based on factors that include, but are not limited to, the size and shape of the susceptor that is to be heated, the type of susceptor temperature distribution desired, and the type of switching circuit. The duration of power provided by the power source 20 via switching circuit 30 to each one of the three coil sections is controlled by control circuit 50. By varying the duration (duty cycle) to each of the three coils sections in a predetermined manner, temperature distribution 70 with uniform longitudinal heating, temperature distribution 71 with increased heating at one end, or temperature distribution 72 with increased middle section heating, as shown in FIG. 5, can be achieved in the susceptor 60 by the induction of eddy currents in the susceptor. Temperature distributions 70, 71 and 72 are typical distribution profiles for all embodiments of the invention that can be achieved by application of the present invention. By properly varying the duration of power to each of the coil sections, different temperature distribution profiles can be achieved without deviating from the scope of the invention.

One type of power source 20 for supplying the high frequency ac in all embodiments of the invention is a solid state power supply which utilizes solid-state high-power thyristor devices such as silicon-controlled rectifiers (SCRs). A block diagram of a typical power source used with induction heating apparatus, and an inverter circuit used in the power source, is described and depicted in FIGS. 1 and 2 of U.S. Pat. No. 5,165,049. That patent is herein incorporated by reference in its entirety. Although the power source in the referenced patent is used with an induction furnace (melt charge), an artisan will appreciate its use with a susceptor 60 in place of an induction furnace. The RLC circuit shown in FIG. 1 of the referenced patent represents a coil section, or load, in the present invention.

A suitable switching circuit 30 for switching power to each of the three coil sections 41, 42 and 43, in FIG. 1 is circuitry including SCRs for electronic switching of power from the power source 20 between coil sections.

The control circuit 50 can be used in all embodiments of the invention to adjust commutation of the SCRs used in the inverter of the power source 20 to maintain a constant inverter power output when the load impedance (coil sections 41, 42 and 43) changes due to switching between the coil sections by the switching circuit 30. One particular type of control circuit that can be used is described in U.S. Pat. No. 5,523,631, incorporated herein by reference in its entirety. In the referenced patent, inverter output power level is controlled when switching among a number of inductive loads. In the present embodiment of the invention, the coil sections 41, 42 and 43 represent the switched inductive loads. The power set potentiometer associated with each switched inductive load in the referenced patent can be used to set a desired average power level defined by the duration of power application to each of the coil sections 41, 42 and 43. Additional control features disclosed in the referenced patent, including means for adjusting the output of the power source (inverter) to each coil section based upon the overshoot or undershoot of the power value provided to the coil section during the previous switching cycle, are also applicable to the control circuit 50 and power source 20 of the present invention.

In all embodiments of the invention, one or more temperature sensors, such as thermocouples, can be provided in or near the susceptor 60. The sensors can be used to provide feedback signals for the control circuit 50 to adjust the output of the power source 20 and the duration of the source's connection to each coil section by the switching circuitry, so that the temperature distribution along the length of the susceptor 60 can be closely regulated.

Figure 2:
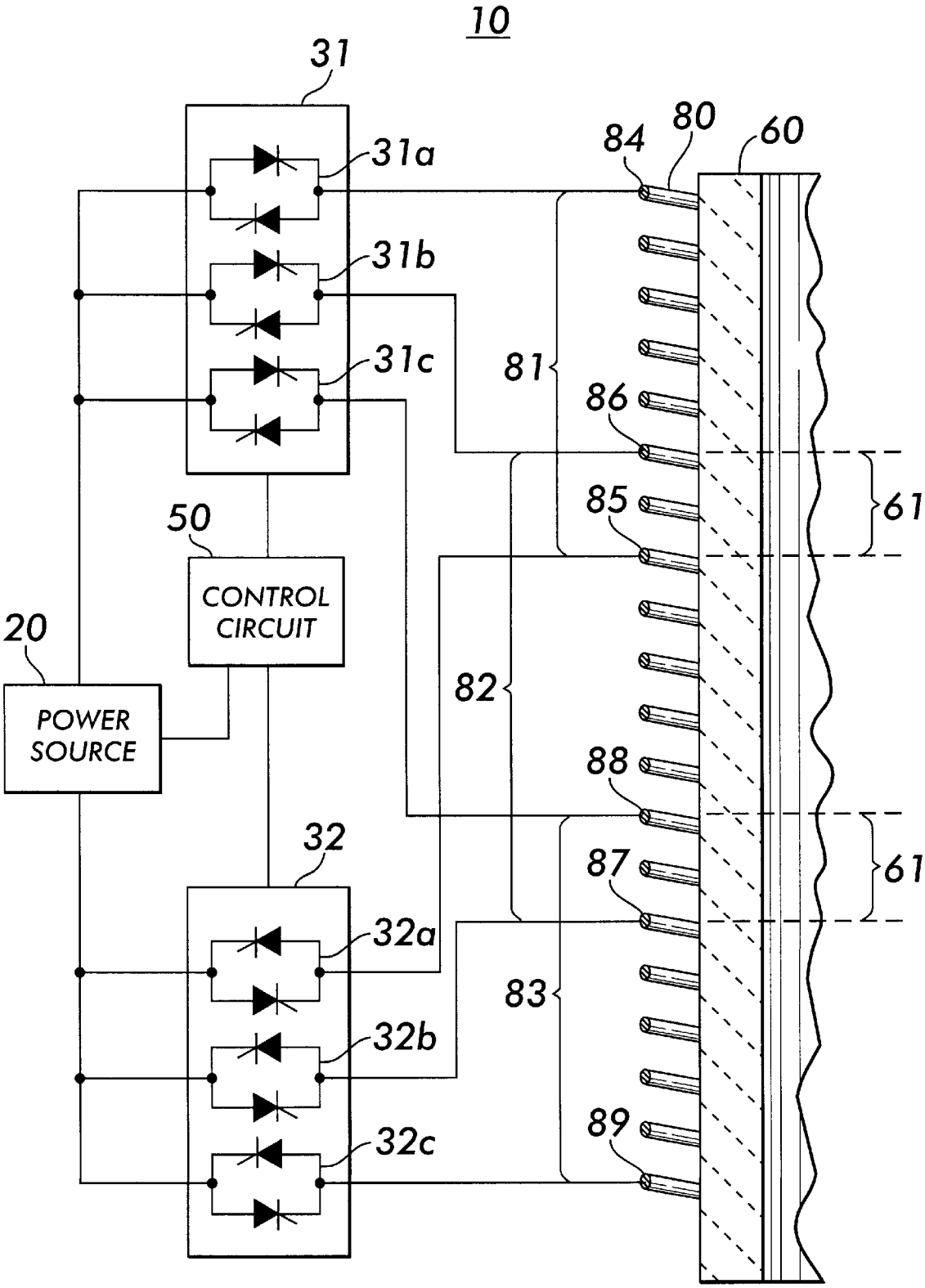
FIG. 2 is a diagram of an alternate embodiment of the present invention having a multi-section induction coil with overlapping coil sections and switching circuits for each coil section.

FIG. 2 shows another embodiment of the present invention. In FIG. 2, coil sections 81, 82 and 83 of the multi-section induction coil 80, partially overlap along longitudinal segments 61 of the susceptor 60. The number of overlapping longitudinal segments 61 will depend upon the number of coil sections used. Depending upon the desired temperature distribution, not all segments need to be overlapped. The segments 61 may be of different lengths to achieve a particular temperature distribution. Each coil section has a pair of terminations: 84 and 85 for coil section 81; 86 and 87 for coil section 82; and 88 and 89 for coil section 83. As shown in FIG. 2, one termination of each coil section is connected to switching circuit 31. The other termination of each coil section is connected to the second switching circuit 32. The switching circuits 31 and 32 include pairs of anti-parallel SCRs 31*a*, 31*b*, 31*c*, 32*a*, 32*b* and 32*c*. Each coil section has one termination connected to a pair of anti-parallel SCRs in switching circuit 31, and the other termination is connected to a pair of anti-parallel SCRs in switching circuit 32. For example, for coil section 81, termination 84 is connected to the pair of anti-parallel SCRs 31*a*, and termination 85 is connected to the pair of anti-parallel SCRs 32*a*. Power source 20 is connected to all pairs of anti-parallel SCRs as shown in FIG. 2. Control circuit 50 controls the duration of power provided by the power source 20 to each of the three coil sections 81, 82 and 83, by the switching circuits 31 and 32. As indicated above, the control circuit 50 can also be used to adjust commutation of the SCRs used in the inverter of the power source 20 to maintain a constant inverter power output when the load impedance changes due to the switching between coil sections by the switching circuits 31 and 32. In this embodiment of the invention, each of the three coil sections is connected to the power source 20 for a preselected time, or duty cycle, via its associated pair of anti-parallel SCRs in the switching circuits 31 and 32. Consequently, the associated SCRs conduct full coil section current and must withstand full coil voltage when in the open state. By varying the duty cycle of power to each of the three overlapping coil sections in a predetermined manner, a typical uniform temperature distribution 71 shown in FIG. 5 can be achieved in the susceptor 60 by the induction of eddy currents in the susceptor 60.

Figure 3:
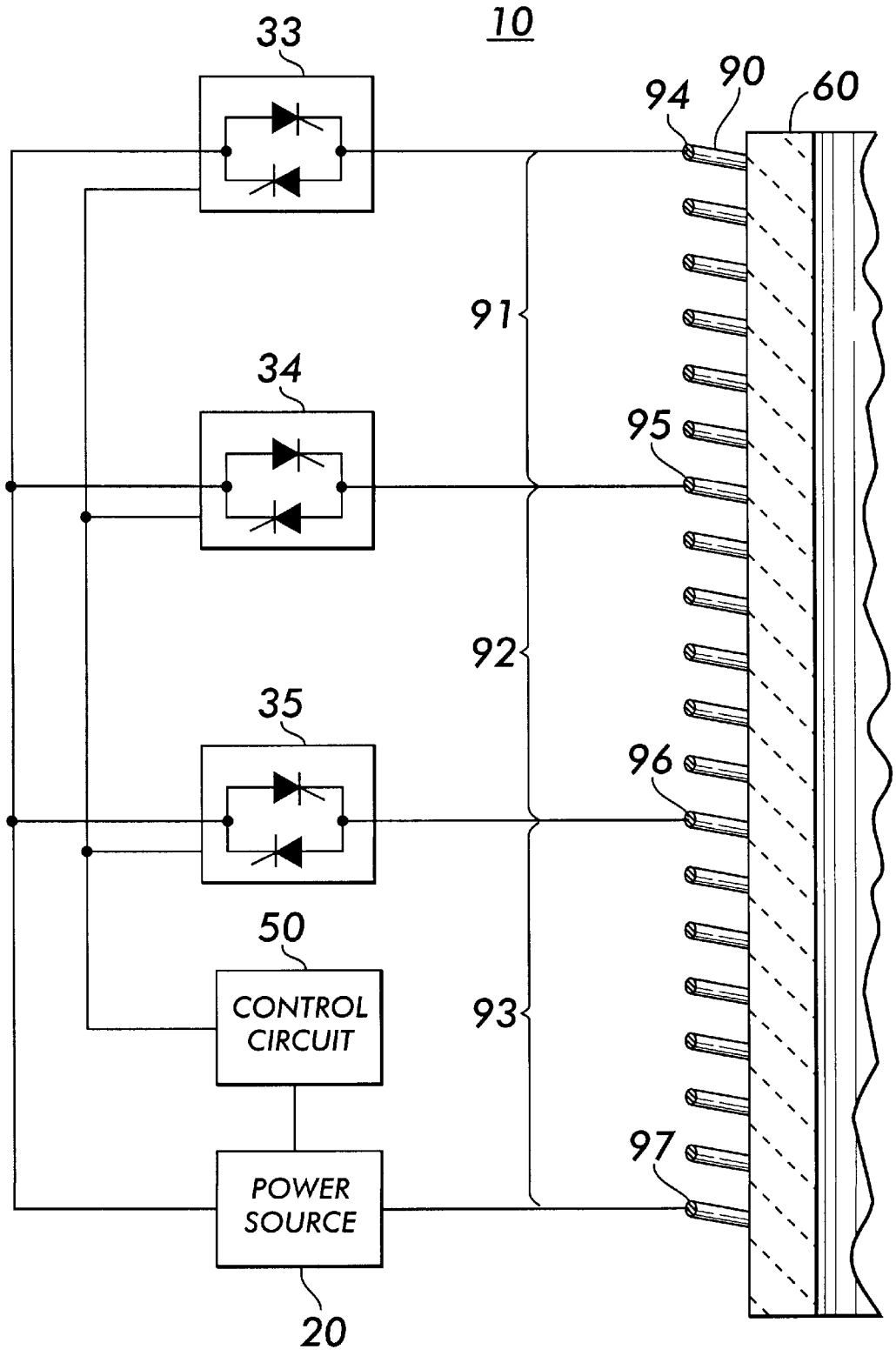
FIG. 3 is a diagram of an alternate embodiment of the present invention having a multi-section induction coil and switching circuits for each coil section.

There is shown in FIG. 3 another embodiment of the present invention. In FIG. 3, a separate switching circuit, 33, 34 or 35, is provided for each of the three coil sections 91, 92 and 93 of the multi-section induction coil 90. The terminations of the coil sections can be coil taps on a continuous coil wound around the length of the susceptor 60. As shown in FIG. 3, coil tap 94 is connected to switching circuit 33; coil tap 95 is connected to switching circuit 34; and coil tap 96 is connected to switching circuit 35. Each switching circuit includes a pair of anti-parallel SCRs. Power source 20 is connected to switching circuits 33 through 35, and power source coil tap 97. Control circuit 50 controls the duty cycle of power provided by the power source 20 to each of the three coil sections 91, 92 and 93, by the switching circuits 33, 34 and 35. In this embodiment of the invention, switching circuit 33 provides controlled power to coil sections 91, 92 and 93; switching circuit 34 provides controlled power to coil sections 92 and 93; and switching circuit 35 provides controlled power to coil section 93. By varying the duration of power in a predetermined manner to this cascaded arrangement of coil section switching, with multiple coil sections connected to the power source 20 at the same time, a typical temperature distribution 71 shown in FIG. 5 with cascaded increase in heating of the susceptor 60 from the end associated with coil section 91 to the end associated with coil section 93 can be achieved by the induction of eddy currents in the susceptor 60.

Figure 4:
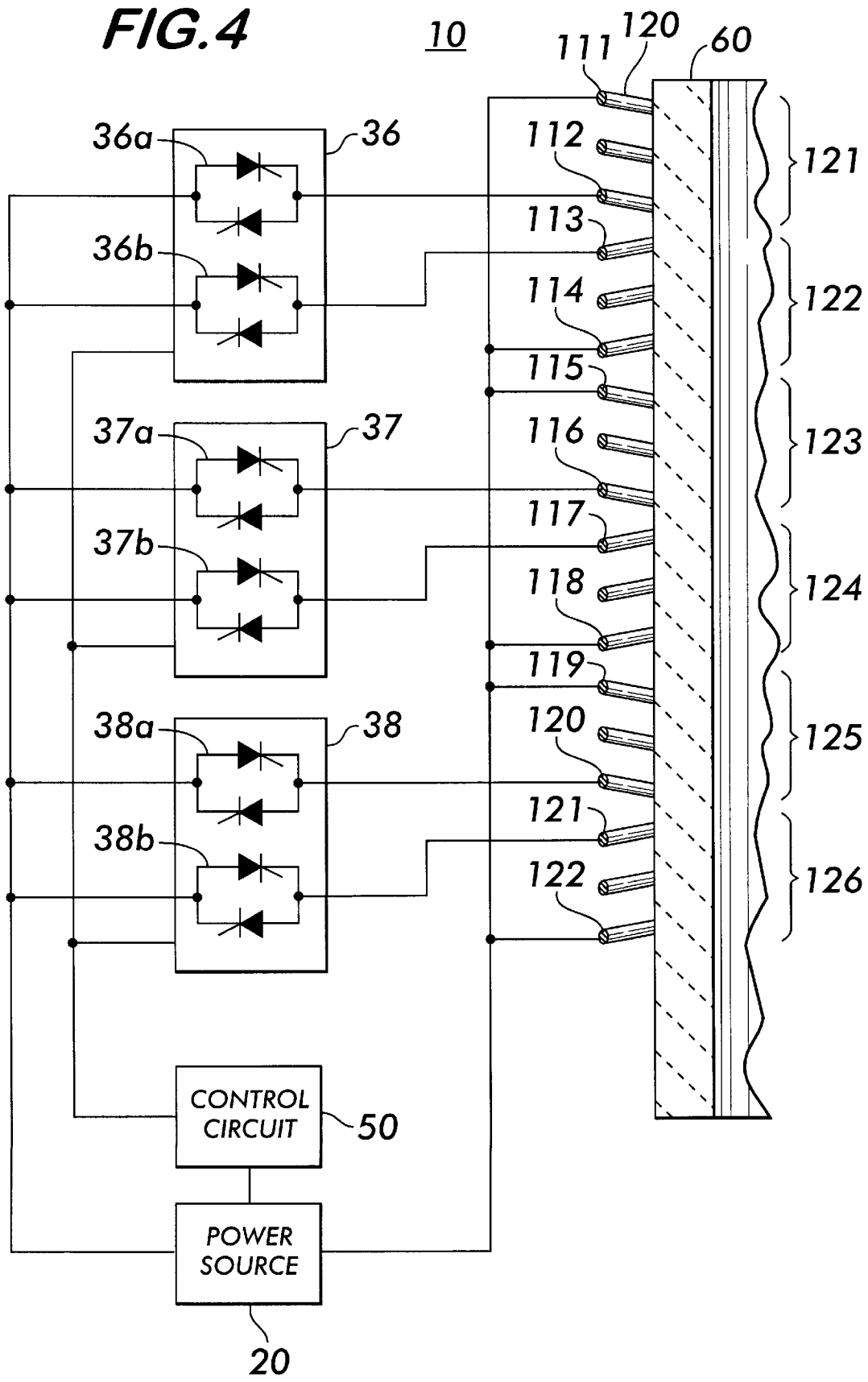
FIG. 4 is a diagram of an alternate embodiment of the present invention having a multi-section induction coil with counter-wound coil sections and switching circuits for each coil section.

FIG. 4 shows an alternative embodiment of the present invention having a multi-section induction coil 120 with coil sections 121 through 126. Coil sections 121, 123 and 125 are counter-wound to coil sections 122, 124 and 126. In the configuration shown in FIG. 4, coil sections 121, 123 and 125 are shown wound in an upward direction, and coil sections 122, 124 and 126 are shown wound in the downward direction. Terminations of the coil sections are as shown in FIG. 4. Adjacent pairs of counter-wound coil sections, namely, 121 and 122, 123 and 124, and 125 and 126, form a coil pair. Each coil pair has its two inner terminations connected to one of the three switching circuits and its two outer terminations connected to the power source 20. For example, for coil pair 121 and 122, terminations 111 and 114 are connected to power source 20 and terminations 112 and 113 are connected to switching circuit 36. The power source 20 is also connected to the three switching circuits 36, 37 and 38. Each switching circuit can include two sets of anti-parallel SCRs that are connected to the two inner terminations of each coil pair. For example, for coil pair 121 and 122, termination 112 is connected to the pair of anti-parallel SCRs 36*a* and termination 113 is connected to pair of anti-parallel SCRs 36*b*. This arrangement assures equal potential between adjacent coil pairs, which allows the coil ends in each coil pair to be brought in close proximity to the coil ends in the adjacent coil pair without danger of arcing between turns. Control circuit 50 controls the duty cycle of power provided by the power source 20 to each of the coil sections. In this embodiment of the invention, each coil pair is provided with controlled power from the power source 20 via one of the switching circuits 36, 37 or 38. Counter-winding the coil pairs can provide a parabolic temperature distribution in the segment of the susceptor that the coil pair is wound around. Consequently, by applying power over a longer time period (or longer duty cycle) for one or more of the pairs of coil sections, an increased heating of a segment of the susceptor can be achieved. For example, by applying power for a longer duty cycle to the coil pair defined by coil sections 123 and 124 in FIG. 4, the temperature distribution 72 shown in FIG. 5 with increased heating in the center length of the susceptor can be achieved. With the same duty cycle of power over equal time periods supplied to each of the three pairs of coil sections, the uniform temperature distribution 70 can be achieved. Numerous types of temperature distributions can be produced by selecting the power cycle and sequence in which power is applied to the pairs of coil sections as described herein.

In each of the embodiments of the inventions, by placing a non-electrically conductive material near the susceptor 60 with a controlled temperature distribution, the material can be heated in a controlled manner. The present invention provides a flexible and adaptable induction heating device for controlling temperature distribution. In addition, the control circuit of the invention and the construction of the multi-section induction coil greatly reduces the complexity and cost of the power source while providing greater efficiency and productivity. These and other advantages of the present invention will be apparent to those skilled in the art from the foregoing specification.

The present invention may be embodied in other specific forms without departing from the spirit or essential attributes thereof. Accordingly, reference should be made to the appended claims, rather than to the foregoing specification, as indicating the scope of the invention.

What is claimed is:

1. An induction heating device for producing a controlled temperature distribution in a non-electrically conductive material, the device comprising:

a power source;

a multi-section induction coil comprising a plurality of coil sections disposed around the length of an electrically conductive material, each coil section having first and second terminations, at least one pair of adjacent coil sections overlapping each other along longitudinal segments of the electrically conductive material the non-electrically conductive material placed within the electrically conductive material to heat the non-electrically conductive material;

at least first and second switching circuits for switching power from the power source between the coil sections, each coil section being powered individually from the power source; and a control circuit for controlling the switching circuits to vary the power supplied from the power source to each of the coil sections in a preselected manner to obtain a controlled temperature distribution along the length of the electrically conductive material.

2. The induction heating device in claim 1 wherein the control circuit adjusts the output of the power source to maintain a constant output when the switching circuit is switched between the coil sections.

3. The induction heating device in claim 1 wherein the switching circuit includes a pair of anti-parallel SCRs connected between the power source and each termination of a coil section.

4. The induction heating device in claim 1 wherein the control circuit senses a power set point for each coil section to determine the power to be supplied to each coil section.

5. The induction heating device in claim 1 wherein the control circuit senses the temperature of selected points on the electrically conductive material to adjust the output of the switching circuit.

6. An induction heating device for producing a controlled temperature distribution in a non-electrically conductive material, the device comprising:

a power source;

a multi-section induction coil comprising a plurality of coil sections disposed around the length of an electrically conductive material, each coil section having first and second terminations, adjacent coil sections being counter-wound to each other, the non-electrically conductive material placed within the electrically conductive material to heat the non-electrically conductive material;

a coil pair formed by adjacent counter-wound coil sections, each coil pair having two center terminations consisting of the second termination of one coil and the first termination of the other coil in the coil pair, and two end terminations consisting of the first termination of said one coil and the second termination of said other coil in the coil pair;

a plurality of switching circuits, a switching circuit connected to the power source and the two center terminations of each coil pair and the power source connected to the two end terminations of each coil pair; and a control circuit for controlling the plurality of switching circuits to vary the power from the power source to the counter-wound coil pairs in a preselected manner to obtain a controlled temperature distribution along the length of the electrically conductive material.

7. The induction heating device in claim 6 wherein the control circuit adjusts the output of the power source to maintain a constant output when the switching circuit is switched between coil sections.

8. The induction heating device in claim 6 wherein the switching circuit includes a pair of anti-parallel SCRs connected between the power source and one termination of a coil section.

9. The induction heating device in claim 6 wherein the control circuit senses power set point for each coil section to determine the power to be supplied to each coil section.

10. The induction heating device in claim 6 wherein the control circuit senses the temperature of selected points on the electrically conductive material to adjust the output of the switching circuit.

* * * * *